US011166105B2

(12) United States Patent
Price

(10) Patent No.: US 11,166,105 B2
(45) Date of Patent: Nov. 2, 2021

(54) MOVABLE DIAPHRAGMS

(71) Applicant: Rex Price, San Jose, CA (US)

(72) Inventor: Rex Price, San Jose, CA (US)

( * ) Notice: Subject to any disclaimer, the term of this patent is extended or adjusted under 35 U.S.C. 154(b) by 0 days.

(21) Appl. No.: 16/839,029

(22) Filed: Apr. 2, 2020

(65) Prior Publication Data

US 2021/0314708 A1 Oct. 7, 2021

(51) Int. Cl.
*H04R 7/18* (2006.01)

(52) U.S. Cl.
CPC ..... *H04R 7/18* (2013.01)

(58) Field of Classification Search
CPC ... H04R 7/06; H04R 7/18; H04R 7/14; H04R 7/10; H04R 7/124; H04R 7/125; G10K 13/00; G10K 11/26
See application file for complete search history.

(56) References Cited

U.S. PATENT DOCUMENTS 3,636,278 A 1/1972 Heil
3,832,499 A 8/1974 Heil
4,039,044 A 8/1977 Heil
4,056,697 A 11/1977 Heil
4,107,479 A 8/1978 Heil
4,160,883 A 7/1979 Heil
5,117,462 A * 5/1992 Bie ..... H04R 1/30 181/159
2015/0110304 A1* 4/2015 Noro ..... H04R 7/127 381/162
2015/0319515 A1* 11/2015 Devantier ..... H04R 1/30 381/345

* cited by examiner

*Primary Examiner* — Sunita Joshi
(74) *Attorney, Agent, or Firm* — Amy Fiene PC

(57) ABSTRACT

A movable diaphragm comprises a layer having a disc shape with undulating waves that extend from an inner diameter to an outer diameter. The layer is to be offset from a stationary surface and displaced toward the stationary surface, the displacement of the layer to effectively cause a respective compression and rarefaction of air between the layer and the stationary surface to an external environment. An annular surround is to seal outer edge portion of the layer to a transducer component, the surround having compliant properties to allow the displacement of the layer relative to the stationary surface and the transducer component without breaking the seal. The undulations increases an effective surface area of the layer to lower an overall size of the transducer that would otherwise be needed for a low frequency speaker.

20 Claims, 7 Drawing Sheets

MOVABLE DIAPHRAGMS

BACKGROUND

The ability to reproduce sounds, such as music and speech, may be largely attributed to loudspeakers. Smaller loudspeakers are found in devices such as radios, televisions, portable audio players, computers, and electronic musical instruments. Larger loudspeakers are found in sound reinforcement in theatres, concert halls, and in public address systems.

DETAILED DESCRIPTION

Figure 1:
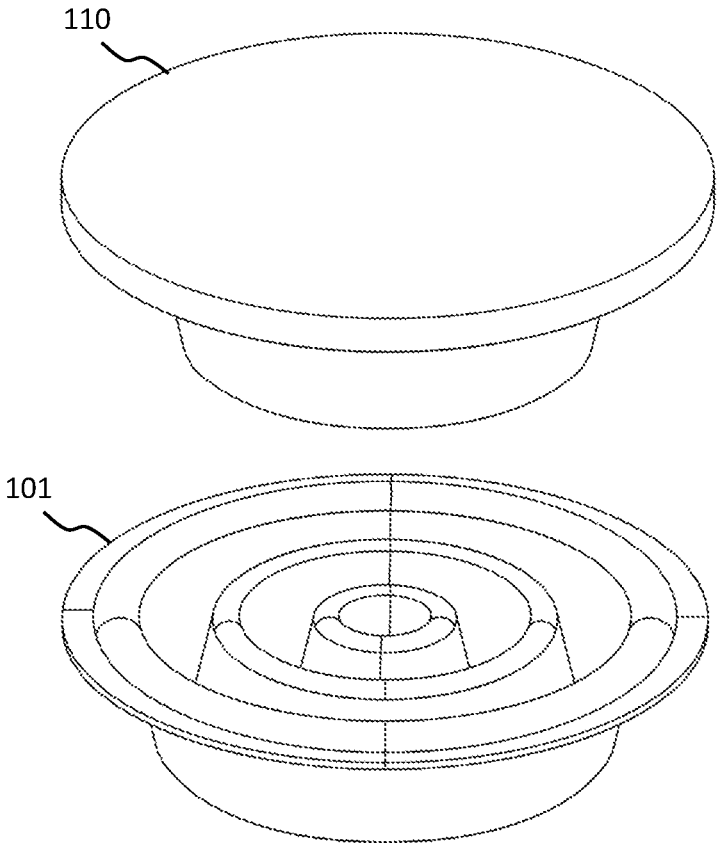
FIG. 1 illustrates an exploded view of a movable diaphragm and a wave guide, according to an example of principles described herein.

A loudspeaker includes at least one transducer that converts an electrical audio signal into a corresponding sound wave that is communicated to a listener. The sound wave may be presented to the listener as music, speech, nature, or another sound.

A transducer of a loudspeaker is housed within an enclosure. The transducer typically includes a lightweight diaphragm that is connected to a rigid basket via a flexible suspension structure including a spider and a surround. The spider constrains a former to move axially through a cylindrical magnetic gap. A permanent magnet in axially alignment with the magnetic gap is held fixed with respect to the former. A protective dust cap attached at or adjacent to the diaphragm's center prevents dust from entering the magnetic gap. When a fluctuating electric current is applied to a coil of wire wound around the former, it induces a rapidly changing magnetic field that causes the coil of wire to be a variable electromagnet that is attracted and repelled by the permanent magnet. As the former moves in response to the magnetic field, the diaphragm attached to the former moves back and forth, producing sound waves into the air.

An example movable diaphragm includes a layer having a symmetrical disc shape with undulating curves that extend from a center or inner diameter to an outer diameter. The layer is to be offset from a stationary surface with outer edge portions of the layer to be sealed by an annular surround to a transducer component. Movement of the layer toward and away from the stationary surface causes a respective compression and rarefaction of air between the layer and the stationary surface relative to an ambient pressure in an external environment. The layer remains offset from the stationary surface during the movement, the surround having compliant properties to allow the movement of the layer relative to the stationary surface and the transducer component without breaking the seal. The undulating curves increase an effective surface area of the layer to lower an overall size of a transducer that would otherwise be needed for a speaker system having a cone-shaped diaphragm.

In another example, a movable diaphragm assembly includes a diaphragm with a layer having a symmetrical disc shape and symmetrical undulating curves that extend from a center or an inner diameter, to an outer diameter. The layer is to be attached at edge portions to a moving speaker component. A wave guide that includes a stationary layer is to be attached at end portions to a fixed speaker component so as to be coaxially offset from the layer. The wave guide includes parallel undulating curves, or other undulating curves that correspond with the undulating curves of the diaphragm layer. The corresponding relationship between waves of the two layers may include, for example, waves mimicking other waves or waves having same or similar properties of other waves. Such properties may include, for example, same or similar amplitudes, wavelengths, frequency, coordinate system, or other properties such that a relationship exists between the waves. The wave guide is to be attached at edge portions to a fixed speaker component so as to be offset from the layer. The speaker component moves the layer to make sound vibrations by moving the layer toward and away from the wave guide and thus causing a respective compression and rarefaction of air between the layer and the stationary surface relative to an ambient pressure in an external environment. The undulating curvature provides an effective surface area of the layer to lower an overall size of the transducer that would otherwise be needed for a given speaker system using a diaphragm with a flat surface area.

In another example, a movable diaphragm assembly includes a layer having a symmetrical disc shape and symmetrical undulating curves that extend from a center or an inner diameter to an outer diameter. The layer is to be attached at edge portions to a moving speaker component. At least one annular surround hermetically seals outer edges of the layer to a transducer component. The movable diaphragm assembly further includes a wave guide that includes a stationary layer with corresponding undulating curves. The stationary layer is to be attached at edges to a fixed speaker component so as to be coaxially offset from the diaphragm layer. The wave guide is angled with respect to the layer from the inner diameter of the layer to the outer diameter of the layer. A cross section between the stationary surface and the layer thus defines a horn shape. The speaker component moves the layer to make sound vibrations by moving the layer toward and away from the wave guide and thus causes a respective compression and rarefaction of air between the layer and the stationary surface relative to an ambient pressure in an external environment. The surround has compliant properties to allow the movement of the layer relative to the stationary surface and the transducer component without breaking the hermetic seal. The undulating curvature of the layer and wave guide provides an effective surface area of the layer to lower an overall size of the transducer that would otherwise be needed for a given speaker system using a diaphragm with a flat surface area.

Turning to FIG. 1, an example of a movable diaphragm 101 with a wave guide 110 is illustrated. The diaphragm 101 includes a layer with uniform thickness and a symmetrical disc shape. The center of the disc as shown includes an inverted dome shape. A plurality of symmetrical, undulating curves extend from the center of the disc to an outer diameter, the undulating curves forming a symmetric ring pattern from the center of the disc to the outer diameter. The wavelike undulating curves are apparent on both sides of the layer. Each successive curve that extends outward from the center includes the same amplitude, or in other words, the same maximum extent of a vibration or oscillation measured from the position of equilibrium, as the center curve. The distance between successive crests of the waves is also the same.

A center of the layer is to be positioned above a former. A curved wall of the layer is dimensioned to surround and seal off top edges, inner sidewalls, or outer sidewalls of a former. For example, curved walls adjacent to the curved walls that form the inverted dome shape may be sealed to outer sidewalls of the former. (see FIG. 5). End portions of the layer extend angularly along a curve so as to be sealed by an annular surround to a transducer component. The layer is to be offset from a stationary surface, the annular surround having compliant properties to allow movement of the layer relative to the stationary surface and the transducer component without breaking the seal.

In an example, the layer includes an inner diameter and an outer diameter, the inner diameter being offset from a central axis to define a central opening within the layer, undulating curves extending from the inner diameter to the outer diameter.

In another example, the curves of the layer may vary in at least one of amplitude and wavelength. Also, the waves may be asymmetric.

In another example, the layer includes angular walls with sharp corners that define a corrugated ring pattern instead of an undulating wave pattern.

The movable diaphragm 101 is used in a transducer to convert an electrical waveform into a pressure wave, electrical energy transformed into acoustic energy, an electrical audio signal thus becoming a corresponding sound. The undulating curves provide an increase in surface area in which to produce sound waves over a typical cone-shaped diaphragm, thus lowering an effective volume of space that would be required by a cone-shaped diaphragm.

The wave guide 110 includes a disc with undulating curves on a surface underneath the disc. The undulating curves correspond to the undulating curves of the movable diaphragm 101 such that the wave guide 110 may be flush, or substantially flush, if the wave guide 110 were to lay on top of the movable diaphragm 101. The center of the disc includes an outwardly extending dome shape with successive curves that extend outward from the center, each curve having a corresponding inverted curve relative to the diaphragm 101, and each curve having the same amplitude and distance between crests as each other. The wave guide 110 is held fixed relative to the movable diaphragm 101. For example, the wave guide 110 may be fixed to an enclosure (see FIG. 13) of a loudspeaker. The movable diaphragm 101 moves relative to the enclosure. For example, the movable diaphragm 101 may be attached at its edge portions by a surround 944 to a basket (see FIG. 13) or other fixed component within the enclosure such that the movable diaphragm 101 may move relative to the enclosure (see FIG. 13) and the wave guide 110.

An amplitude or distance between successive crests may vary. For example, the top of the center curve of the disc shape may be a highest point of the disc and each successive amplitude may be relatively lower. Similarly, the distance between the first two crests may be shortest while each successive distance between crests increase. In another example, the reverse order of height and distance between crests may also be present. The farthest wave from the center curve may have the highest amplitude with decreasing amplitudes for each successive wave toward the center curve. The distance between the farthest set of crests from the center curve may have the shortest distance, with increasing distance between each successive set of crests toward the center curve. In another example, various heights and distances may have a different order or a lack of apparent order. While the undulations are shown as being symmetrical, examples include asymmetric undulations and various curve formations.

The movable diaphragm 101 may also have a central opening (see FIG. 2) or a hole therethrough that is centered in the disc. Undulating waves thus extend from the central opening and include amplitudes and distances between crests that may be the same or similar to that described for FIG. 1. The inner diameter edge portions of the central opening are to attach to top edges, inner sidewalls, or outer sidewalls of a former.

While the movable diaphragm 101 is shown as being a circular shape, other example shapes include being rectangular; rectangular with rounded corners; and rounded, rectangular having flat long sides with half circle shaped ends. Further examples include such shapes as oval or oblong.

The material of the movable diaphragm 101 may include various forms of metal, plastic, paper, glass fiber, carbon fiber, or combinations thereof. The material may have low mass to minimize starting force requirements and energy storage issues, and be well damped to reduce vibrations continuing after the signal has stopped with little or no audible ringing. The material may be rigid to prevent uncontrolled motions and deformation while it is being moved or vibrated by the transducer. The material may have rigidity such that it does not bend and is not forced out of shape by speaker vibrations. The material may be resilient such that it returns to its original shape after incurring deformation by speaker vibrations. The material may be low cost. Also, the material may be substantially impermeable such that a majority of small particles cannot pass through the material of the movable diaphragm. The material may be thin relative to other speaker components. For example, the movable diaphragm may be relatively thinner than a thickness of a basket, a sealing member, back plate, or other component of a transducer. The material may have a thickness such that the diaphragm will not break up at relatively low frequencies with the center of the diaphragm moving out of phase with other parts of the diaphragm.

Figure 2:
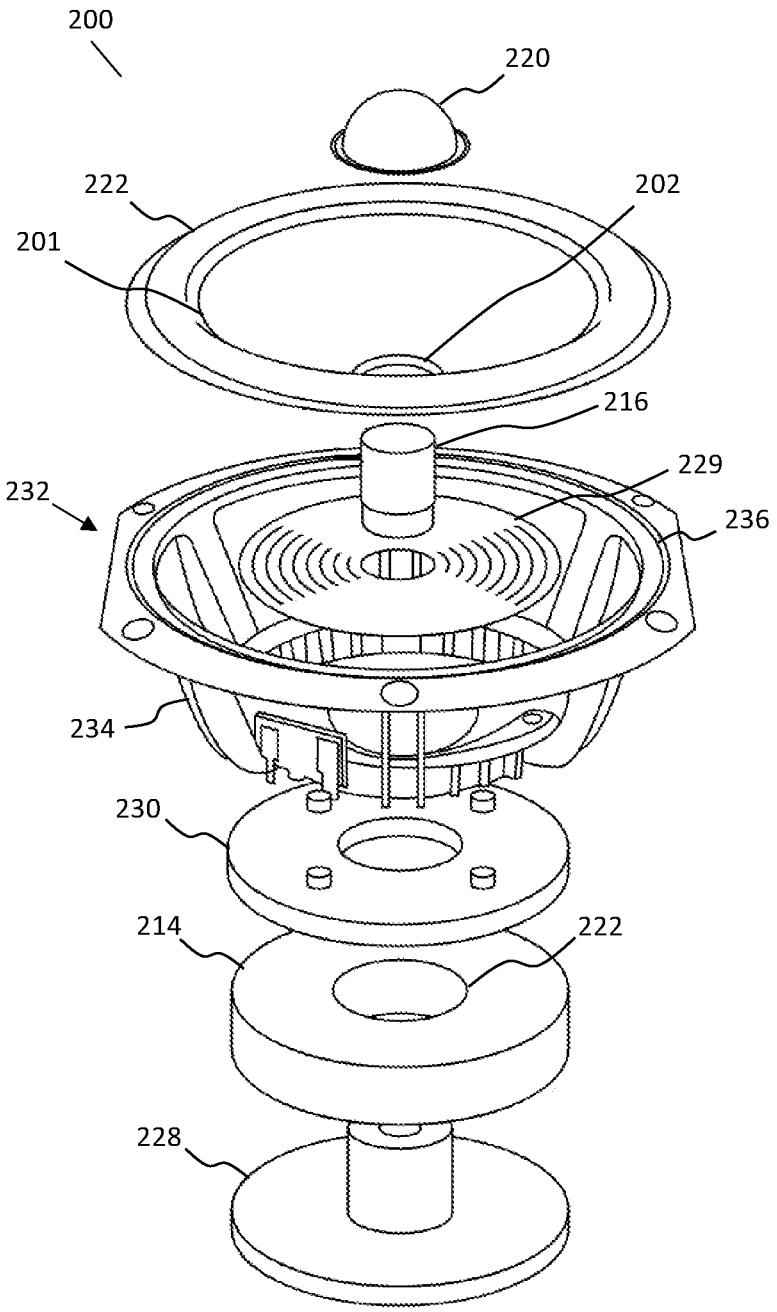
FIG. 2 illustrates an exploded view of a transducer, according to an example of the principles described herein.

FIG. 2 illustrates an exploded view of a typical loudspeaker transducer 200 that may be used with a movable diaphragm in accordance with principles discussed herein. The transducer 200 includes a dust cap 220, diaphragm 201, basket 232, former 216, spider 229, top plate 230, permanent magnet 214, and back plate 228. The former 216 includes a coil of wire, usually made of copper or copper clad aluminum, that is wrapped around a cylinder. When an electrical signal is applied to the coil on the former 216, a magnetic field is created by the electric current in the coil, making it a variable electromagnet. The variable electromagnet causes the former 216, and the movable diaphragm 201 attached to the former 216, to respond to a magnetic field from a nearby permanent magnet 214. The permanent magnet 214 is attached to a top plate 230 and a back plate 228. The top plate 230, permanent magnet 214, and bottom plate 228 are bonded, screwed, or otherwise attached to the basket 232 which is fixed to an enclosure of the loudspeaker or another fixed structure within the enclosure. The response of the former 216 is to rapidly move back and forth, both toward and away from the permanent magnet 214. The movement of the movable diaphragm 201 reproduces sound in accordance with the applied electrical signal. The sound level of acoustic output, commonly measured in decibels (dB), varies with the amplitude of the electrical input signal and the sensitivity of the transducer 200.

The movable diaphragm 201 as shown includes a cone-shaped profile. A surround 222 connects outer edge portions of the movable diaphragm 201 to the basket 232. A spider 229 connects the former 216 to the basket 232. The movable diaphragm 201 and former 216 move together as a unit. The spider 229 and the surround 222 provide a restorative, constraining force to return the diaphragm 201 and former 216 to an original position after being moved axially within the basket 232 away from their original position.

The spider 229 includes a corrugated disc that forms a concentric ring pattern. The corrugated disc of the spider 229 has a central opening and edge portions of the central opening attach to outer sidewalls of the former 216. In an example, outer edge portions of the corrugated disc of the spider 229 attach to sides of the basket 232. The outer edge portions remain fixed to the non-moving basket 232 to provide a stronghold for the former 216 as it moves rapidly in response to the variable magnetic field. The spider 229 thus allows a controlled displacement of the former 216 and movable diaphragm 201 within the basket 232. The movable diaphragm 201 is connected at its outer edge portions to the basket 232 by the surround 222 so that it is constrained by its outer edge portions in its movement with the former 216.

The basket 232 includes a supportive framework or housing for the movable diaphragm 201 and the former 216, as well as other speaker components. Structural support members 234 located around the sides of the basket 232 curve upward from a common bottom to a top opening to form a cup-like structure. In other examples, the structural support members 234 are straight and angular, straight up to the top opening, or have other formation. Around top edges, a generally flat annular rim 236 extends radially outward. The movable diaphragm 201 is connected to the rim 236 by an annular surround 222 that is positioned in between the movable diaphragm 201 and rim 236 to provide them with a substantially air tight seal. The annular surround 222 is a circular or otherwise curved ring that includes resilient properties to allow the movable diaphragm 201 to move relative to the basket 232 without losing the seal between the movable diaphragm 201 and the rim of the basket 232. In addition to sealing the movable diaphragm 201 to the basket 232, the surround 222 is also used to align the former 216 and movable diaphragm 201 for free pistonic motion aligned with the permanent magnet 214. At the opposite end of the movable diaphragm 201, the base includes a central opening 202. Edge portions of the central opening 202 of the movable diaphragm 201 are attached around top edges, inner sidewalls, or outer sidewalls of the former 216.

A protective dust cap 220 is a curved dome structure mounted either in concave or convex orientation over the central hole of the movable diaphragm 201. The dust cap 220 attached over the central opening of the former 216 prevents dust, especially iron filings, from entering the central opening 202, and contacting speaker components. As shown, the dust cap 220 is mounted in a concave orientation.

Figure 3:
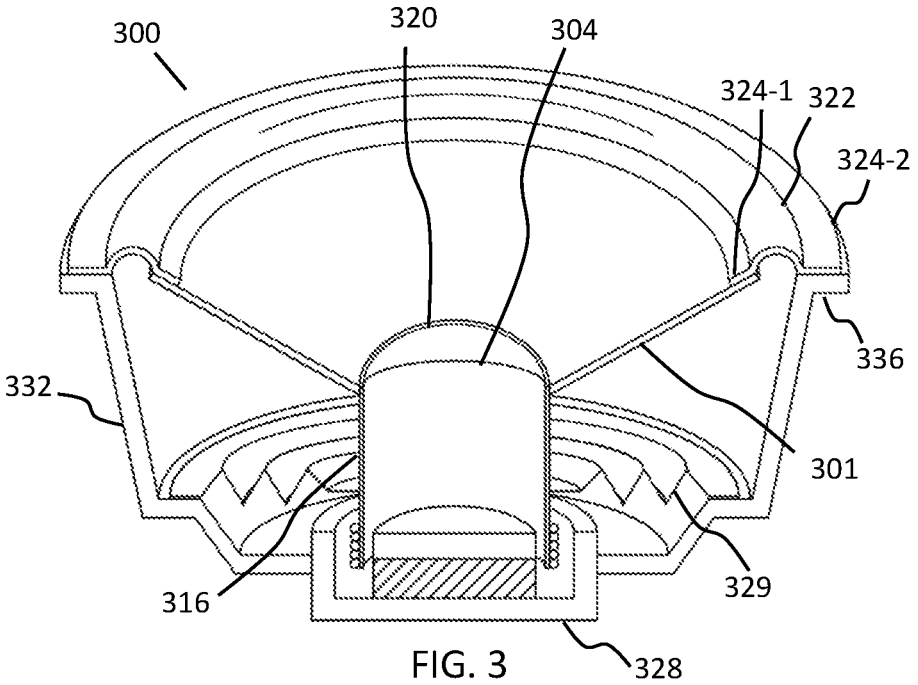
FIG. 3 illustrates a cutout view of a transducer, according to an example of the principles described herein.

FIG. 3 illustrates a cutout view of the transducer 300 like the transducer 200 in FIG. 2, the cutout view highlighting the profile of the movable diaphragm 301 and its attachment to the former 316 and the basket 332 by the surround 322. The movable diaphragm 301 in FIG. 3 includes a central opening 304 which has an inner diameter. Edge portions of the central opening 304 attach to top edges, inner sidewalls, or outer sidewalls of the former 316 with an airtight or substantially airtight seal. The dust cap 320 covers the central opening 304 of the former 316 and seals the top central opening 304 of the former 316 with an airtight or substantially airtight seal. An example includes that the former 316 is a cylinder with a central opening or a hollow therethrough. The dust cap 320 closes off and seals the central opening of the former 316.

The surround 322 includes a half roll member with flanges 324-1, -2, flange 324-1 extending radially inward from the half roll member and flange 324-2 extending radially outward from the half roll member. Flange 324-1 attaches to edge portions of the movable diaphragm 301 while flange 324-2 attaches to the rim 336 of the basket 332. Inner edge portions of the spider 329 attach circumferentially around outer sidewalls of the former 316 and outer edge portions of the spider 329 attach to sides of the basket 332. Also shown is the back plate 328 which is held fixed while the former 316, dust cap 320, spider 329, and diaphragm 301 are moved relative to the back plate 328 by the magnetic field interaction with the permanent magnet 314.

Figure 4:
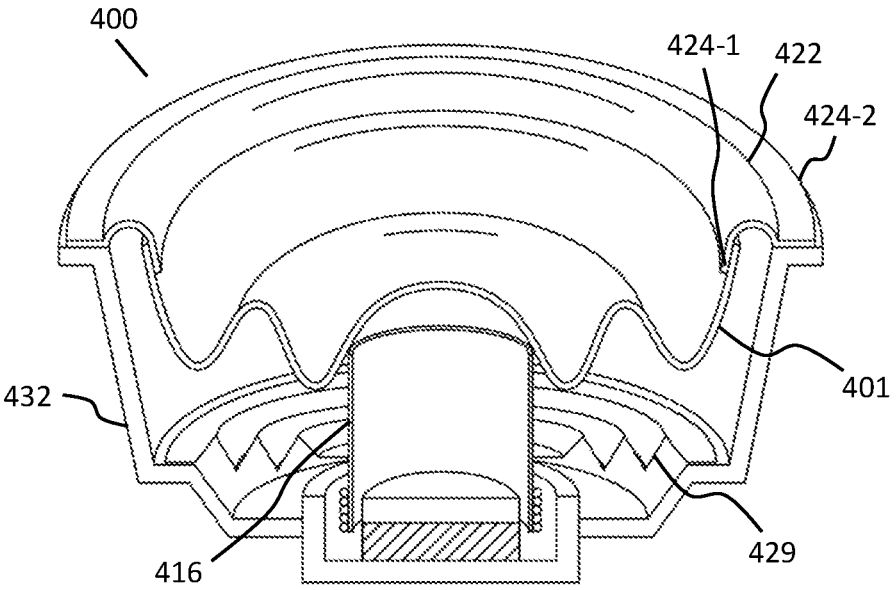
FIG. 4 illustrates a cutout view of a transducer, according to an example of the principles described herein.

FIG. 4 illustrates an example of a transducer 400 with a movable diaphragm 401 that includes a layer having a symmetrical disc shape. The layer includes undulating curves that extend radially outward from a center of the disc to an outer diameter. As shown, the movable diaphragm 401 includes a center wave and two undulations.

The annular surround 422 seals outer edge portions of the movable diaphragm 401 to a fixed transducer component, such as the basket 432 shown. Wave end portions at the outer diameter of the layer extend angularly along a curve so as to attach to the inner flange 424-1. The outer flange 424-2 is attached to the rim of the basket 432 with an airtight or substantially airtight seal to complete the attachment of the movable diaphragm 401 to the basket 432. The surround 422 includes an annular ring having compliant properties to allow movement of the layer relative to the stationary surface and the basket 432 without breaking the seal. Particularly, the half roll member of the surround 422 is flexible so that it can bend and deform as the movable diaphragm 401 moves.

The movable diaphragm 401 may be moved with or without respect to a stationary surface above it. The spider 429 moves with the former 416 and the movable diaphragm 401, the spider 429 having no contact with the movable diaphragm during the movement. Outer edge portions of the spider 429 attach the former 416 to the basket 429 which enables the spider 429 to provide a restoring force on the movable diaphragm 401 back to its neutral position. The annular surround 422 also provides a restoring force.

As shown, a crest of the center wave of the movable diaphragm 401 is centered above sidewalls of the former 416. Inner facing sides of the center wave attach to top edges of the former 416. In an example, the center wave and the attachment of the sides of the center wave to at least one of inner or outer sidewalls and top edge portions of the former 416 replace a dust cap. In other examples, a dust cap lays on top of the center wave to attach to at least one of the movable diaphragm 401 and top edges, inner sidewalls, outer sidewalls of the former 416.

In another example, the movable diaphragm 401 includes a layer with a central opening (not shown) having an inner diameter offset from a central axis to define a central opening like the central opening 304 of the diaphragm 301 in FIG. 3. A substantially airtight seal, or another type of seal that prevents the passage of air, oxygen, or other gases from entering the central opening may further be in place. A dust cap (see 320 in FIG. 3) may be attached to edge portions of the central opening of the layer to cover and seal off the central opening 304. The dust cap may further be attached to top edges, inner sidewalls, or outer sidewalls of the former 416. In an example, the dust cap includes a surface that follows the curvature of the layer, so that the undulating waves of the layer are continuous or substantially continuous. The dust cap may have a cone shape or inverted cone shape type of attachment to the former 416.

In another example, the surround 422 is a continuous material extension with the movable diaphragm 401. Furthermore, the surround and the dust cap may be part of the layer 401 so that the layer is continuous from end to end, edge portions of the layer attached to edges of the basket 432 and the layer attached to the former 416. While the surround may take the form of a half roll with outer flanges, examples include a whole roll with flanges, a single layer like the diaphragm, a corrugated layer, or other type of form. The surround may have a similar thickness or higher or lower thickness than the layer of the diaphragm. Furthermore, the surround may include multiple layers with a same thickness or varied thickness. Properties of the surround include at least one of being compliant, resilient, lightweight, substantially impermeable, and having a structural integrity and tensile strength to support the layer while stationary or during movement.

The undulating curves of the movable diaphragm 401 increase the surface area available for the transducer 400 compared to the cone shape surface area of the movable diaphragm 301 in FIG. 3. As a result, the effective surface area of the layer of the movable diaphragm 401 lowers an overall size of the transducer that would otherwise be needed for a speaker system with a cone-shaped diaphragm (see movable diaphragm 301 in FIG. 3). Also, the movable diaphragm 401 may be made to have a smaller diameter and yield the same surface area of a cone-shaped diaphragm having a larger diameter. Limitations on speaker enclosure sizes thus still allow for larger surface areas than what is provided by a cone-shaped diaphragm.

The undulating curves of the movable diaphragm 401 may have the same amplitude and wavelength or at least one amplitude and wavelength that differs from the rest. As shown, the adjacent wave to the center wave has a lower amplitude than the center wave. The trough in between the center wave and the adjacent wave is lower than the subsequent trough. In an example, a crest may be as high as the surround 422 or the basket 432. In another example, a crest may be lower than a top of the dust cap (see dust cap 320 in FIG. 3).

Figure 5:
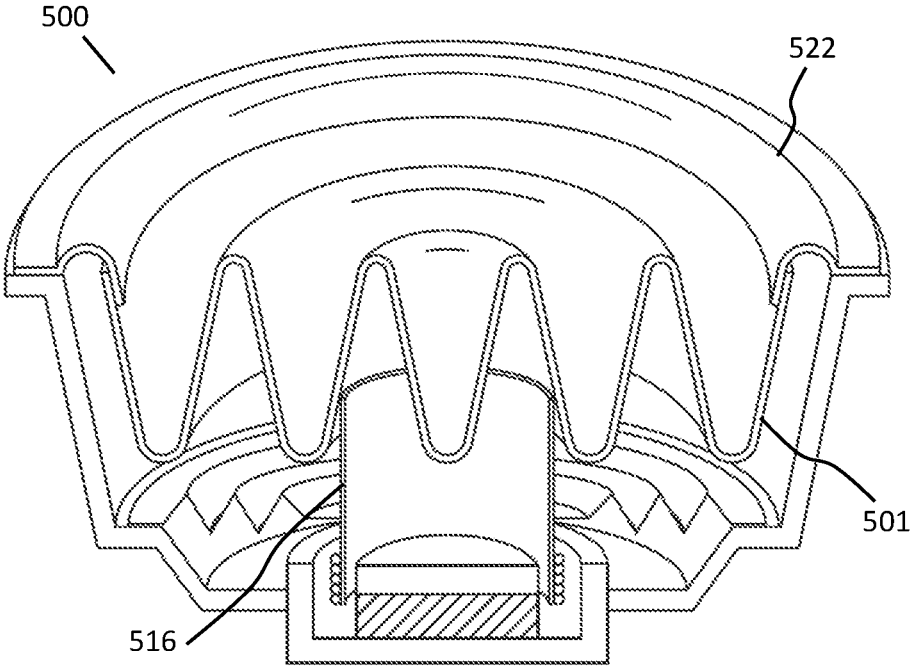
FIG. 5 illustrates a cutout view of a transducer, according to an example of the principles described herein.

FIG. 5 illustrates an example of a transducer 500 with a movable diaphragm 501 having a layer with a central undulation and two outer undulations. The increase in the number of undulations compared with the number of undulations in the movable diaphragm 401 in FIG. 4 demonstrates that each additional undulation serves to increase the overall surface area, which correlates to an increase in compression and rarefaction of air molecules for producing sound when the movable diaphragm 501 moves. Compression of air refers to the force or pressing together of air molecules and thus an increase in density of air relative to ambient air pressure. Rarefaction of air refers to extra space given for air molecules to expand and thus a decrease in density of air relative to ambient air pressure. Ambient air pressure may be the air pressure of an environment that is external to an enclosure in which the transducer 500 is housed. The number of undulations is not to be limited to the number of undulations represented in FIG. 5.

The movable diaphragm 501 in FIG. 5 includes undulations with equal amplitude and equal wavelength. A center undulation of the movable diaphragm 501 includes a trough disposed within a central opening of the former 516. At least a portion of the trough is disposed within the central opening. Subsequent undulations extend radially outward from the center undulation. Sides of the center undulation curve from the trough angle upward to a first crest that is above the central opening. An adjacent undulating curve is formed by sides that slant downward from the first crest and then upward to a second crest that is the same height as the first crest. Sides of the adjacent undulating curve that slant downward from the first crest are attached to inner or outer sidewalls or top edges of the former 516. The sides may be sealed with an airtight, or substantially airtight seal to the inner or outer sidewalls or top edges of the former 516. The seal may include glue, adhesive, or other bonding material between the layer and the former.

The movable diaphragms 401 and 501 are to be offset from a stationary surface (not shown) that are fixed above them and remain without contact while the movable diaphragms 401 and 501 are in motion or at a standstill. Movement of the movable diaphragms 401 and 501 toward and away from the stationary surface (not shown) causes a respective compression and rarefaction of air between the layer and the stationary surface relative to an ambient pressure.

Figure 6:
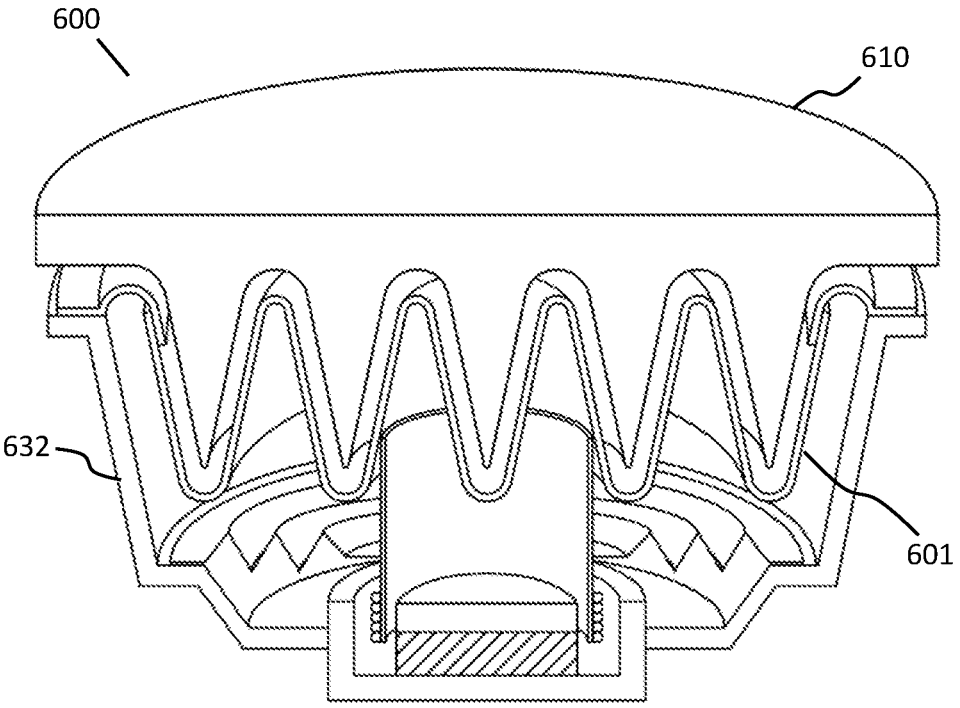
FIG. 6 illustrates a cutout view of a transducer, according to an example of the principles described herein.

FIG. 6 illustrates an example of a transducer 600 with a movable diaphragm 601 like the movable diaphragm 501 in FIG. 5 but with a stationary surface in the form of a wave guide 610. The wave guide 610 includes a disc-like member that spans the top opening of the basket 632. A bottom facing surface of the wave guide 610 includes undulating curves that correspond to the undulating curves of the movable diaphragm 601. The undulating curves of the wave guide 610 may be similar to or the same as the undulating curves of the movable diaphragm 601. As shown, the wave guide 610 includes corresponding undulations with sharper edged troughs than the corresponding troughs of the movable diaphragms 601. The undulations of the wave guide 610 have a nesting type relationship if the wave guide 610 were to be placed within the movable diaphragm 601 such that the undulations of the wave guide 610 would lay within the undulations of the movable diaphragm 601. The wave guide 610 is fixed relative to the rapid back and forth displacement of the movable diaphragm 601. For example, the wave guide 610 may be fixed to a speaker enclosure or to the basket 632. The movable diaphragm 601 does not come into contact with the wave guide 610 during its movement or when it is stationary. The wave guide 610 is a stiff member such that it is resistant to bending, torsion, and vibration. The wave guide may be comprised of, for example, at least one of injection molded plastic, aluminum, magnesium, wood, or cast metal.

Figure 7:
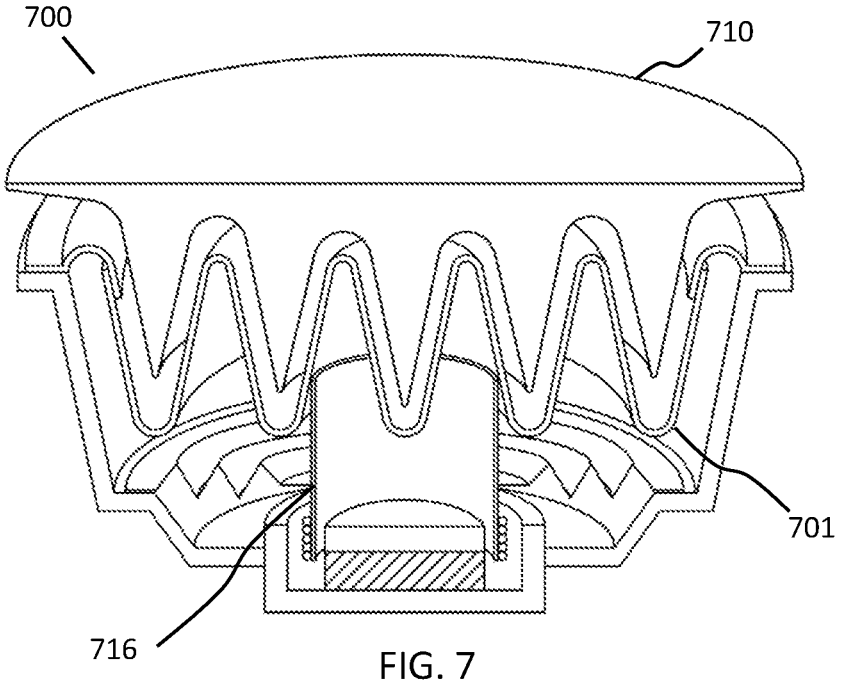
FIG. 7 illustrates a cutout view of a transducer, according to an example of the principles described herein.

FIG. 7 illustrates another example of a transducer 700 with a movable diaphragm 701 and a wave guide 710. The movable diaphragm 701 is the same as the movable diaphragm 601 in FIG. 6, however, the wave guide 710 has a different undulation pattern from the wave guide 610. The wave guide 710 includes a center undulation and radially extending undulations, the undulations of the layer following a linear path as they extend radially outward, the linear relationship of the wave guide 710 relative to a coordinate axis associated with the movable diaphragm 701. Each successive wave from the center undulation is stepped higher than the previous wave by the same amount. As a result, the undulations of the wave guide 710 are increasingly separated from their counterpart undulations of the movable diaphragm 701 with a steady gain as they move from the center of the movable diaphragm 701 to the outer diameter of the movable diaphragm 701. With the linear relationship, air space between the movable diaphragm 701 and the wave guide 710 increases according to a straight angle from respective centers radially outward to outer diameters. The profile of the wave guide 710 may be characterized as having a cone shape but with undulations in the wave guide 710.

Figure 8:
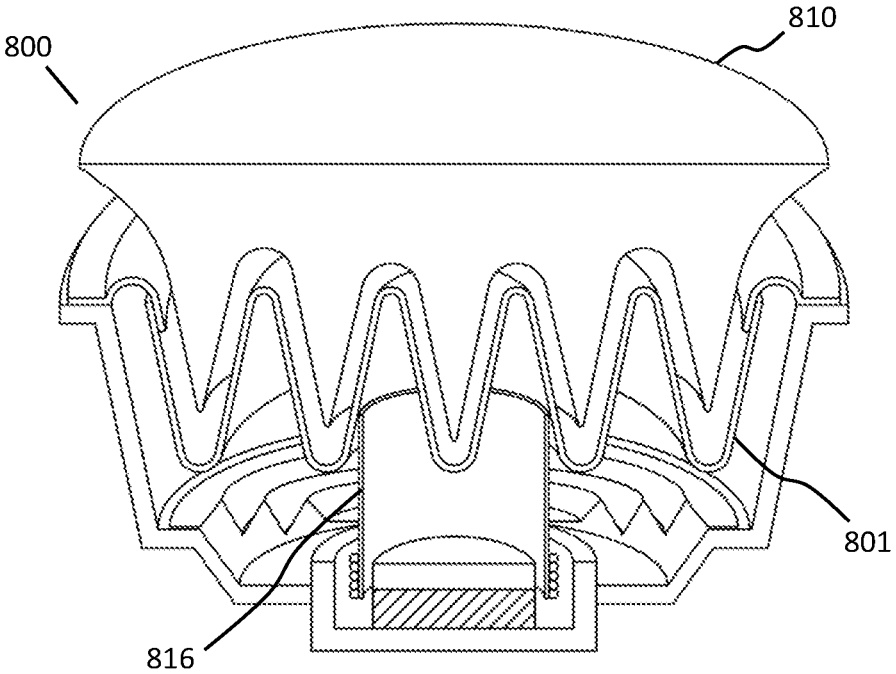
FIG. 8 illustrates a cutout view of a transducer, according to an example of the principles described herein.

FIG. 8 illustrates another example of a transducer 800 with a movable diaphragm 801 and a wave guide 810 but with an exponential relationship. The movable diaphragm 801 is the same as the movable diaphragm 601 (see FIG. 6) and 701 (see FIG. 7) in FIG. 7. The center undulation of the movable diaphragm 801 includes a portion of the center undulation disposed within the central opening of the former 816. Subsequent undulations extend radially outward from the center undulation.

The wave guide 810 includes corresponding undulations to the movable diaphragm 801 like the wave guide 710 and movable diaphragm 701 in FIG. 7, however, each subsequent undulation from the center undulation of the wave guide 810 is stepped higher than the previous undulation according to an exponential relationship. Each undulating wave adjacent to the center undulation follows an exponential curve relative to the movable diaphragm 801, the undulations of the wave guide 810 having an exponential relationship relative to a coordinate system associated with the undulations of the movable diaphragm 801. With the exponential relationship, air space between the movable diaphragm 801 and the wave guide 810 increases according to an exponential curve from respective centers radially outward to outer diameters. The profile of the wave guide 810 may be characterized as having an exponential curve but with undulations in the wave guide 810.

Figure 9:
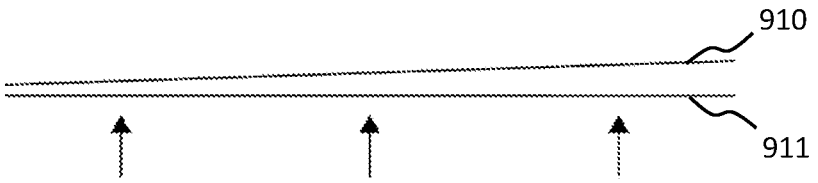
FIG. 9 illustrates a profile of a diaphragm and a wave guide, according to an example of the principles described herein.
Figure 10:
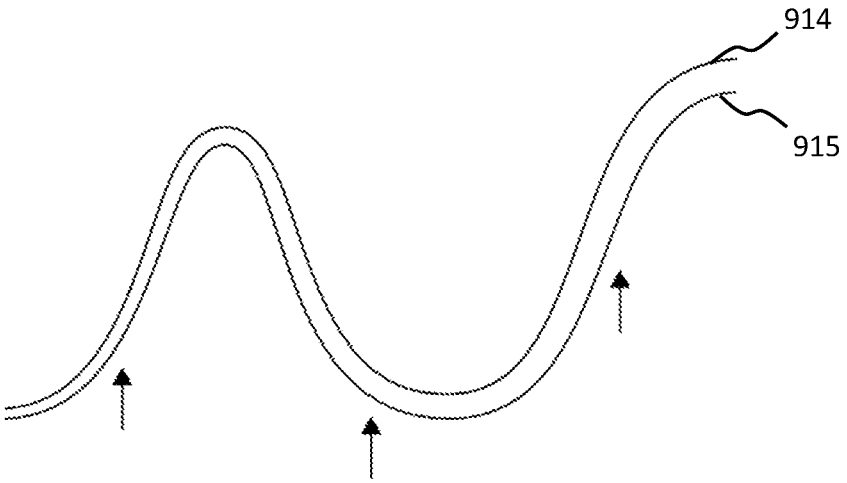
FIG. 10 illustrates a profile of a diaphragm and a wave guide, according to an example of the principles described herein.

FIGS. 9 and 10 illustrate the profile of a horn loudspeaker compared to the undulating wave form loudspeaker according to principles discussed herein. In FIG. 9, the wave guide 910, which could also be another type of stationary surface, has a linear relationship with the movable diaphragm 911. A movable diaphragm 911 moves toward and away from the wave guide 910, as indicated by arrows.

In FIG. 10, the wave guide 914 and the movable diaphragm 915 combine a linear relationship but with an undulating curve. The movable diaphragm 915 moves toward and away from the wave guide 914, as indicated by arrows. The increased curvature provides an increase in surface area with respect to the previous profiles in FIG. 9. The application of the linear relationship can be seen with the wave guide 710 and movable diaphragm 701 in FIG. 7. This relationship directly influences the size of the transducer and the loudspeaker enclosure that may be used.

Figure 11:
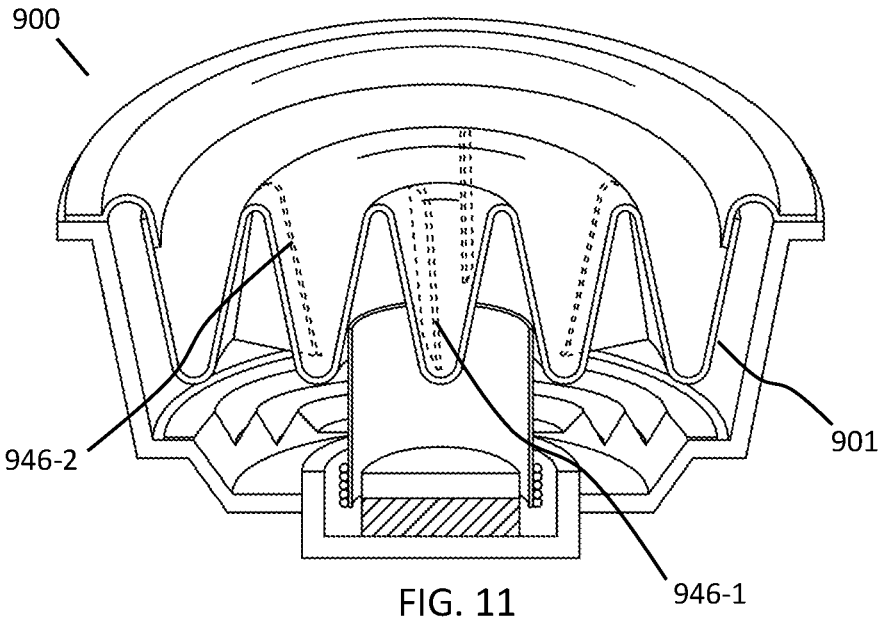
FIG. 11 illustrates a cutout view of a transducer, according to an example of the principles described herein.

FIG. 11 illustrates an example of a transducer 900 that includes a movable diaphragm 901 with a plurality of stiffening members 946-1, -2 as indicated by dotted lines, each stiffening member 946-1, -2 to reinforce the undulating curve to which it is attached. One stiffening member 946-1 is attached below the center undulation and three stiffening members 946-2 are attached at spaced intervals around the concentric ring pattern of the subsequent undulation. Each stiffening member 946-1, -2 includes a flat wing-like panel that is shaped according to the respective undulating curvature of the layer. Attachment of a stiffening member 946-1, -2 may occur either to an undulating curve on top of the layer or an undulating curve underneath the layer. The stiffening members 946-1, -2 shown are attached below respective undulations. The length of the stiffening member 946-1, -2 may extend to the full length, a substantial length, or merely a portion of the crest or trough of the undulating curve. In an example, at least one stiffening member 946-1, -2 is attached to an undulating curve of the layer. The stiffening members may be equally or unequally spaced around respective undulations.

Figure 12:
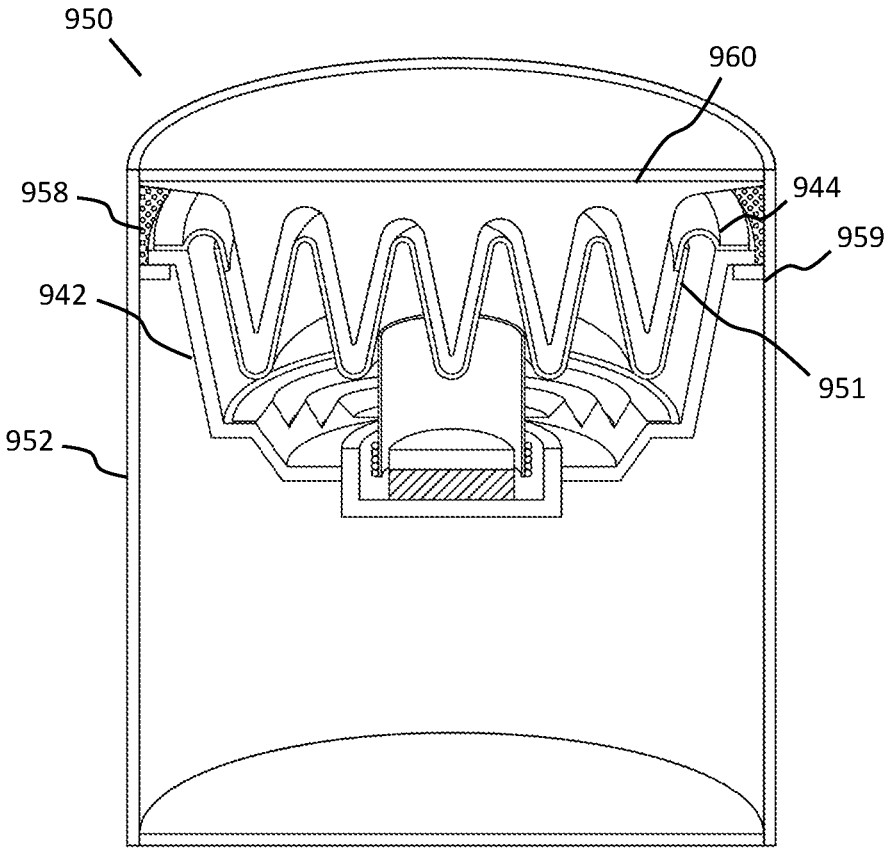
FIG. 12 illustrates a cutout view of a transducer in an enclosure, according to an example of the principles described herein.

Transducers are typically housed in a speaker enclosure, or outer casing, which may be a rectangular box or cylinder made of wood, plastic, or other material that has stiffness and that is prone to being non-resonant. The enclosure materials and design affect the quality of the sound produced. FIG. 12 illustrates a transducer 950 with an enclosure 952. The enclosure 952 shown is a cylinder, however other shapes are anticipated. In an example, the surface areas of the movable diaphragm and the wave guide are a determining factor in the size of the enclosure.

The transducer 950 includes a movable diaphragm 951 and a wave guide 960 as shown. The movable diaphragm 951 is attached to a basket 942 by the annular surround 944. Outer edges of the basket 942 are attached to structure of the enclosure 952. As shown, outer edges of the basket 942 are attached to an inner flange 959 that extends radially inward. Space defined between the enclosure 952, wave guide 960, surround 944, basket 942, and inner flange 959 allows for ventilation holes 958 as shown by small circles. Ventilation holes 958 allow air to travel to and away from the enclosure 952. Other structure may be used to constrain a stationary surface with a movable surface within the enclosure 952. Also, ventilation holes may not be necessary when taking into account a way for sound waves to propagate away from the enclosure. The ventilation holes may be round, square, rectangular, oblong, or have other shape. Examples include stand-offs without ventilation holes or other structure that does not impede air flow but that are present to provide structural rigidity to the enclosure that may be used with ventilation holes or in place of ventilation holes.

With the enclosure 952 designed to be used with movable diaphragms and wave guides according to principles discussed herein, the enclosure 952 may be smaller compared with existing movable diaphragms and wave guides having cone-shaped and horn-shaped profiles. Dimensions of the enclosure 952 that are affected may include diameter, height, as well as other dimensions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A movable diaphragm for a transducer, comprising:

a layer having a symmetrical disc shape with undulating curves that extend from an inner diameter to an outer diameter, the layer having a central opening, outer edge portions of the central opening to attach to at least one of inner or outer sidewalls and top edges of a former, a center of the layer to be positioned above a former, a curved wall of the layer dimensioned to surround and seal off sidewalls of the former, end portions of the layer extending angularly along a curve so as to be sealed by an annular surround to a transducer component, the layer to be offset from a stationary surface, movement of the layer toward and away from a stationary surface of the transducer causing a respective compression and rarefaction of air between the layer and the stationary surface relative to an ambient pressure in an external environment, the layer remaining offset from the stationary surface during the movement, the annular surround having compliant properties to allow the movement of the layer relative to the stationary surface and the transducer component without breaking the seal, the undulating curves increasing an effective surface area of the layer to lower an overall size of the transducer that would otherwise be needed for a speaker system having a cone-shaped diaphragm.

2. The movable diaphragm of claim 1, wherein the speaker component is a basket of a speaker.

3. The movable diaphragm of claim 1, wherein the stationary surface is part of a wave guide.

4. The movable diaphragm of claim 1, wherein the stationary surface follows the curvature of the layer.

5. The movable diaphragm of claim 1, wherein the amplitude and wavelength of the undulations remain constant from the inner diameter to the outer diameter.

6. The movable diaphragm of claim 1, wherein movement of the layer occurs without contact between the layer and the stationary surface.

7. The movable diaphragm of claim 1, wherein the undulating curves of the wall curve at least downward and upward and downward.

8. A movable diaphragm assembly, comprising:

a layer having a symmetrical disc shape and symmetrical undulating curves that extend from a center of the layer to an outer diameter, the layer to be attached at edges to a moving speaker component;

a wave guide that includes a stationary layer with corresponding undulating curves, the wave guide to be attached at edges to a fixed speaker component so as to be offset from the layer;

the speaker component moving the layer to make sound vibrations by moving the layer toward and away from the wave guide and thus causing a respective compression and rarefaction of air between the layer and the stationary surface relative to an ambient pressure in an external environment, the undulating curvature providing an effective surface area of the layer to lower an overall size of the transducer that would otherwise be needed for a given speaker system using a diaphragm with a flat surface area.

9. The movable diaphragm assembly of claim 8, further comprising at least one annular surround to seal the outer edge portions of the layer to a transducer component, the surround having compliant properties to allow movement of the layer relative to the wave guide and the transducer component without breaking the seal.

10. The movable diaphragm assembly of claim 8, wherein the layer includes at least one of rounded, rectangular, and rectangular with rounded corners disc shape.

11. The movable diaphragm assembly of claim 8, wherein a sidewall of the layer is sealed to at least one of top edges, inner sidewalls, and outer sidewalls of a former.

12. The movable diaphragm assembly of claim 1, wherein the wave guide is angled with respect to the layer from the inner diameter of the layer to the outer diameter of the layer, a cross section between the stationary surface and the layer defining a horn shape.

13. The movable diaphragm assembly of claim 1, wherein the layer and the wave guide extend exponentially outwardly away from each other from the inner diameter to the outer diameter, a cross section of the layer and the wave guide defining a flared horn shape.

14. The movable diaphragm assembly of claim 1, wherein the layer includes at least one stiffening member attached to an undulating curve, the at least one stiffening member having a stiffness to reinforce the structure of the layer.

15. The movable diaphragm assembly of claim 8, the layer comprising at least one property of being relatively stiff, rigid, resilient, lightweight, low cost, and substantially impermeable.

16. The movable diaphragm assembly of claim 8, wherein the inner diameter is offset from a central axis to define a central opening within the layer.

17. The movable diaphragm assembly of claim 16, wherein edge portions of the central opening of the layer are to be attached to a dust cap, at least one of the layer and the dust cap to be attached to a former of a speaker system.

18. A movable diaphragm assembly, comprising:

a layer having a symmetrical disc shape and symmetrical undulating curves that extend from an inner diameter to an outer diameter, the layer to be attached at end portions to a moving speaker component;

at least one annular surround to seal outer edge portions of the layer to a transducer component;

a wave guide that includes a stationary layer with corresponding undulating curves, the wave guide to be attached at end portions to a fixed speaker component so as to be offset from the layer, the wave guide angled with respect to the layer from the inner diameter of the layer to the outer diameter of the layer, a cross section between the stationary surface and the layer defining a horn shape;

the speaker component moving the layer to make sound vibrations by moving the layer toward and away from the wave guide and thus causing a respective compression and rarefaction of air between the layer and the stationary surface relative to an ambient pressure in an external environment, the surround having compliant properties to allow the movement of the layer relative to the stationary surface and the transducer component without breaking the seal, the undulating curvature providing an effective surface area of the layer to lower an overall size of the transducer that would otherwise be needed for a given speaker system using a diaphragm with a flat surface area.

19. The movable diaphragm assembly of claim 18, wherein the speaker component is a basket and the transducer component is a speaker enclosure.

20. A movable diaphragm for a transducer, comprising:

a layer having a symmetrical disc shape with undulating curves that extend from an inner diameter to an outer diameter, the amplitude and wavelength of the undulations remaining constant from the inner diameter to the outer diameter, a center of the layer to be positioned above a former, a curved wall of the layer dimensioned to surround and seal off sidewalls of the former, end portions of the layer extending angularly along a curve so as to be sealed by an annular surround to a transducer component, the layer to be offset from a stationary surface, movement of the layer toward and away from a stationary surface of the transducer causing a respective compression and rarefaction of air between the layer and the stationary surface relative to an ambient pressure in an external environment, the layer remaining offset from the stationary surface during the movement, the annular surround having compliant properties to allow the movement of the layer relative to the stationary surface and the transducer component without breaking the seal, the undulating curves increasing an effective surface area of the layer to lower an overall size of the transducer that would otherwise be needed for a speaker system having a cone-shaped diaphragm.

* * * * *